United States Patent [19]

Tegg et al.

[11] Patent Number: 4,769,863

[45] Date of Patent: Sep. 13, 1988

[54] HAND WASH UNIT

[75] Inventors: Duane T. Tegg; Perry M. Domaas, both of Brooklyn Center; Michael A. Holm, Hugo, all of Minn.

[73] Assignee: Satellite Industries, Inc., Minneapolis, Minn.

[21] Appl. No.: 64,232

[22] Filed: Jun. 19, 1987

[51] Int. Cl.[4] ..... A47K 1/02; A47K 5/12

[52] U.S. Cl. ..... 4/625; 4/616; 4/619

[58] Field of Search ..... 4/191, 195, 262, 265, 4/626, 628, 638, 639, 640, 650, 654

[56] References Cited

U.S. PATENT DOCUMENTS

| | | | |
|---|---|---|---|
| 1,358,937 | 11/1920 | Curliss | 4/626 |
| 3,594,830 | 7/1971 | Clifton | 4/625 |
| 3,983,583 | 10/1976 | Herman et al. | 4/626 X |
| 4,130,123 | 12/1978 | Wines et al. | 4/626 X |
| 4,332,040 | 6/1982 | Palmer | 4/625 X |
| 4,340,981 | 7/1982 | Vonags | 4/625 X |
| 4,454,613 | 6/1984 | Palmer | 4/625 X |

*Primary Examiner*—Donald Watkins

*Attorney, Agent, or Firm*—Herman H. Bains

[57] ABSTRACT

A portable hand wash unit is comprised of a tank having a dispenser housing hinged to the upper portion of the tank. The dispenser housing is shaped to define a pair of wash basins, each having a water outlet connected in continuous communication with a metering receptacle and each basin having a soap dispenser pump connected in communicating relation with a soap reservoir. Each wash basin is provided with a manual water pump which pumps clear water from a bag of water within the tank through the inlet of each metering receptacle. The inlet for each metering receptacle has a cross-sectional size approximately twice the cross-sectional size of the water outlet, thereby allowing a user the time needed to wash his hands after the user has finished operation of the water pump.

11 Claims, 10 Drawing Sheets

8
8
23
112
23b
110
109
28
111
23a
73
14
12
74
73
15
13
11

11
23
73
74
113
111
112
110
109
14
23a
23b
12

55
39
31
32
63
65
55

22
60
59
53
63
54
55
65
55
53
65
10
10
43
47
49
51
52
60
54
58
63
56
53
31
32
37
40
38
27
42

24
29
25

HAND WASH UNIT invention relates to a hand wash unit and, more particularly, to a portable hand wash unit.

BACKGROUND OF THE INVENTION

Although commercial portable restroom units are used for outdoor concerts, athletic events, and the like, these units usually do not have hand wash facilities. Further, there are no commercial portable hand wash units for use in conjunction with portable restroom units or, for that matter, any outdoor activities.

SUMMARY OF THE INVENTION

It is an object of this invention to provide a novel portable hand wash unit, of simple and inexpensive construction, which may be readily transported from site to site, and which may be easily serviced.

Another object of this invention is to provide a novel portable hand wash unit having its own water supply and having a unique water dispenser, including a pump and metering receptacle, which is operable to dispense water after the operation of the pump has been discontinued.

A further object of this invention is to provide a novel portable hand wash unit, including a tank having a bag or bags therein, one of which contains water, which is dispensed in metered amounts by a manually operable dispensing system, and in which the soiled water is discharged into the other bag within the tank.

These and other objects of the invention are more fully defined in the following Specification.

FIGURES OF THE DRAWING

DESCRIPTION OF THE PREFERRED EMBODIMENT

Figure 1:
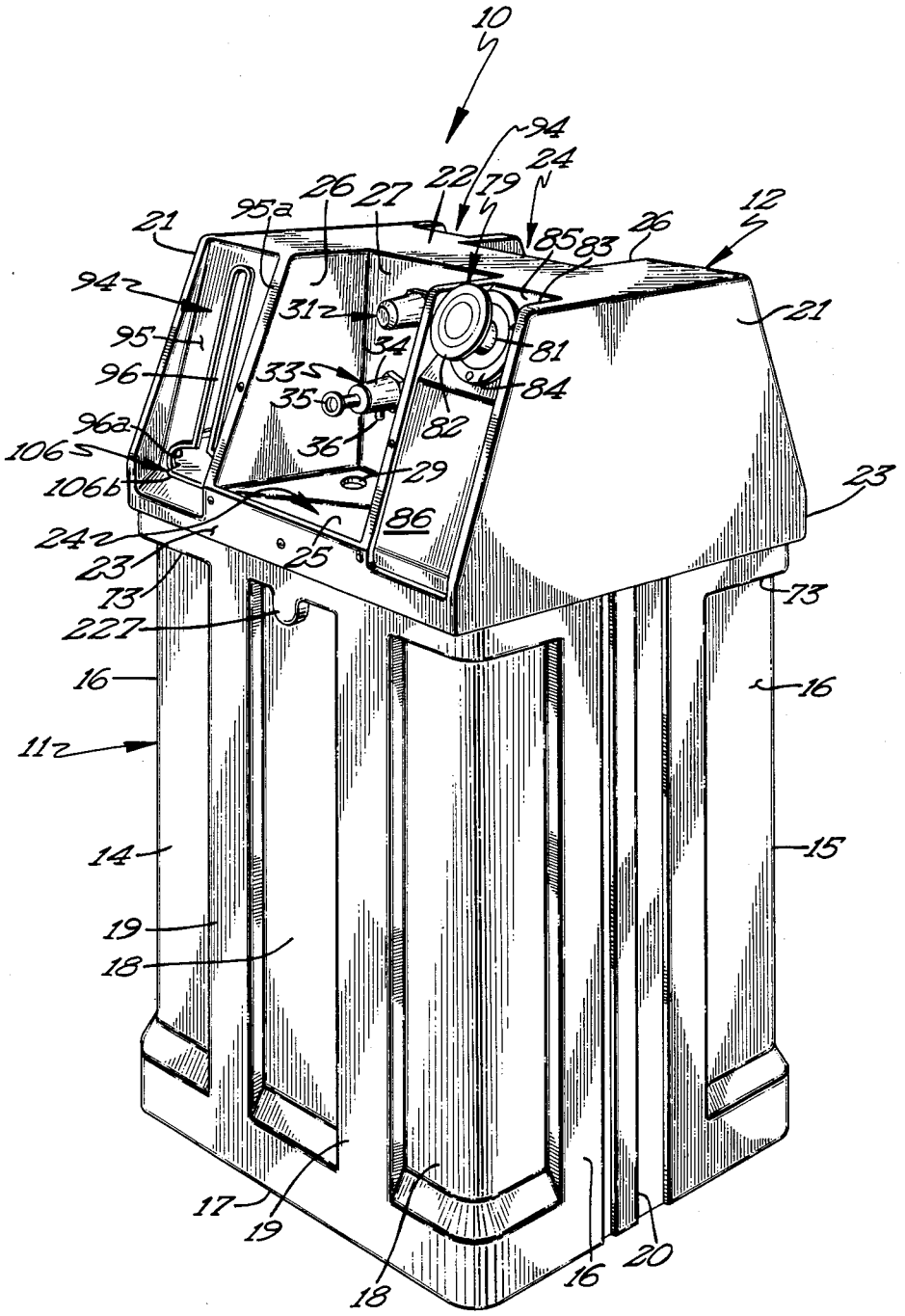
FIG. 1 is a perspective view of the novel hand wash unit.

Referring now to the drawings and, more specifically, to FIG. 1, it will be seen that one embodiment of the novel hand wash unit, designated generally by the reference numeral 10, is thereshown. The hand wash unit 10 is comprised of a generally rectangular shaped open-top container or receptacle 11 and a dispenser housing 12 which is hingedly connected thereto by a hinge 13. Both the tank and dispenser housing are formed of a plastic material and are produced in a molding operation.

In cross-section, the container 11 is generally square and includes a front wall 14, a rear wall 15, side walls 16, and a bottom wall 17. It will be noted that the container 11 is provided with molded in vertically extending recesses 18 to define embossed or raised ribs 19 between adjacent recesses to thereby impart strength and rigidity to the structure. The particular configuration, size, and position of the recesses and ribs is a matter of design and other parameters relating to the tank.

It will be noted that the dispenser housing 12 has no lower wall. The dispenser housing includes a pair of flat generally vertically disposed end walls 21 having a slight upwardly taper and a top wall 22. The front and rear portions of the dispenser housing are each shaped into a plurality of compartments, each including an outer vertical wall 23 which extends transversely across the full extent of the associated front or rear portions.

Figures 5, 7, 8, 10:
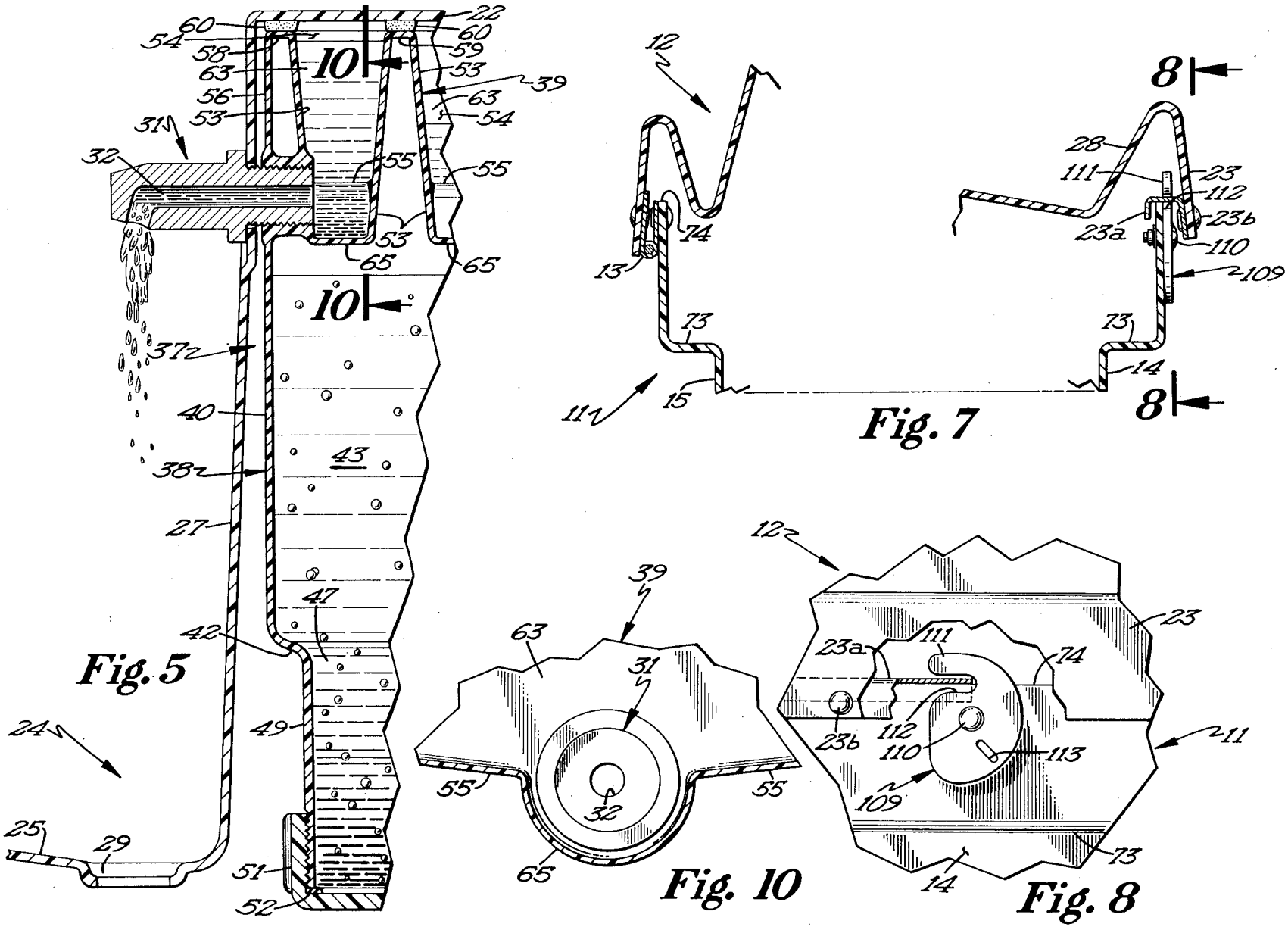
FIG. 5 is a cross-sectional view taken approximately along the line 5—5 of FIG. 3 and looking in the direction of the arrows.
FIG. 7 is a cross-sectional view taken approximately along the line 7—7 of FIG. 3 and looking in the direction of the arrows.
FIG. 8 is a cross-sectional view taken approximately along the line 8—8 of FIG. 7 and looking in the direction of the arrows.
FIG. 10 is a cross-sectional view taken approximately along the line 10—10 of FIG. 3 and looking in the direction of the arrows.

Each front and rear portion has a centrally located recess therein which defines a wash basin compartment 24. Each wash basin compartment 24 includes a floor or a bottom wall 25, which is integral with a pair of opposed spaced apart vertically disposed side walls 26 and a vertically disposed rear transverse wall 27. It will be noted that the floor 25 slopes rearwardly from an inclined transverse front wall 28 which is integrally connected to the associated outer vertical wall by an arcuate portion. The floor of the wash basin not only slopes rearwardly, but also slightly transversely to one corner thereof. This depressed corner has a drain opening or outlet 29 therein, as best seen in FIG. 5. The inclination of the floor of each basin is sufficient to permit drainage when the surface upon which the unit is positioned is not plumb.

It will be seen that each wash basin 24 is provided with a generally horizontally disposed water dispenser spout or outlet 31, which is mounted on the rear transverse wall 27, which projects outwardly therefrom. The water dispenser spout 31 has a downwardly facing opening 32 adjacent its outer end through which water is discharged into the wash basin 24.

Each wash basin 24 also includes a manually operable soap dispenser pump 33, which is also mounted on the associated rear transverse wall 27 and projects interiorly thereof. It will be seen that water and liquid soap dispensed from the water dispenser spout and soap dispenser pump, and used by a user, will be discharged through the drain outlet 29.

The soap dispenser pump 33 includes a pump body or cylinder 34 having a piston or plunger 35 mounted therein and projecting therefrom and being capable of reciprocating movement during operation of the soap dispenser pump. It will be appreciated that, when the plunger 35 is urged inwardly of the pump body, liquid soap will be dispensed through the outlet 36 of the pump body. The pump body is provided with a spring (not shown) which yieldably resists inward movement of the plunger and urges the latter outwardly.

Referring now to FIGS. 2–5 and 10, it will be seen that both the water dispenser spout 31 and the soap dispenser pump 33 are connected in communicating relation with a reservoir structure 37 positioned interiorly of the dispenser housing 12. The reservoir structure 37 includes a soap reservoir and a pair of metering water receptacles 39. It will be noted that the metering water receptacles 39 are positioned above the soap reservoir 38.

Figure 2:
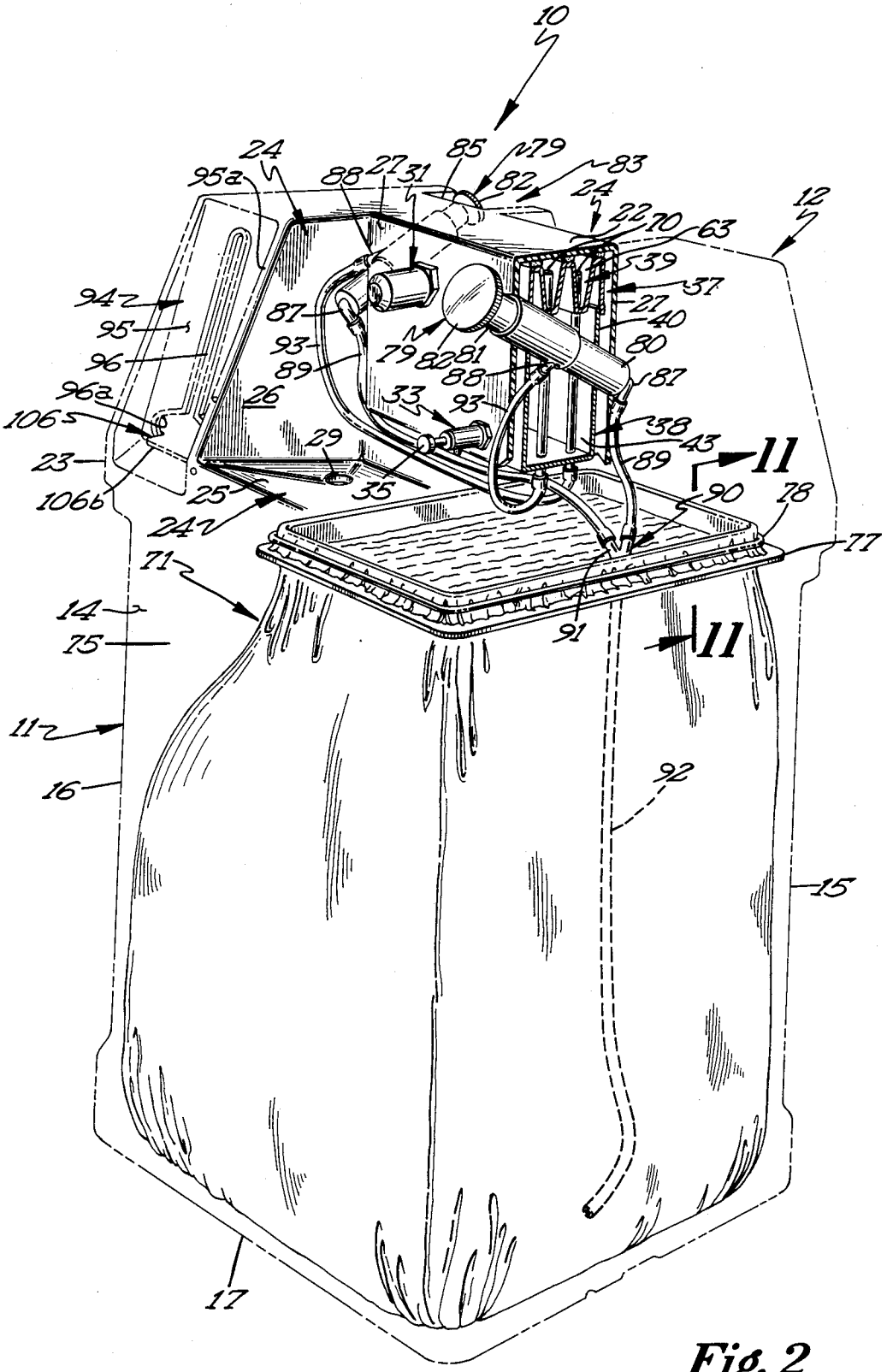
FIG. 2 is a perspective view of certain components of the hand wash unit, with the tank and dispenser housing shown in dotted configuration.
Figure 3:
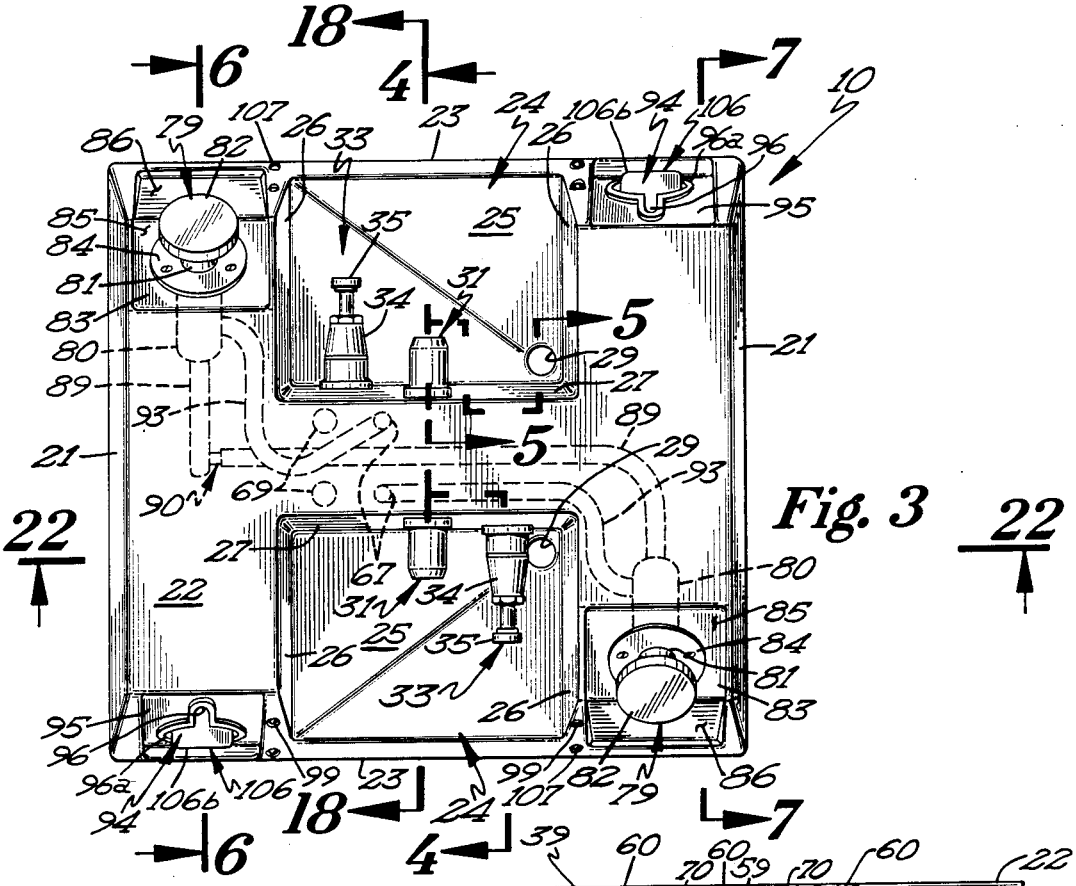
FIG. 3 is a top plan view of the hand wash unit.
Figure 4:
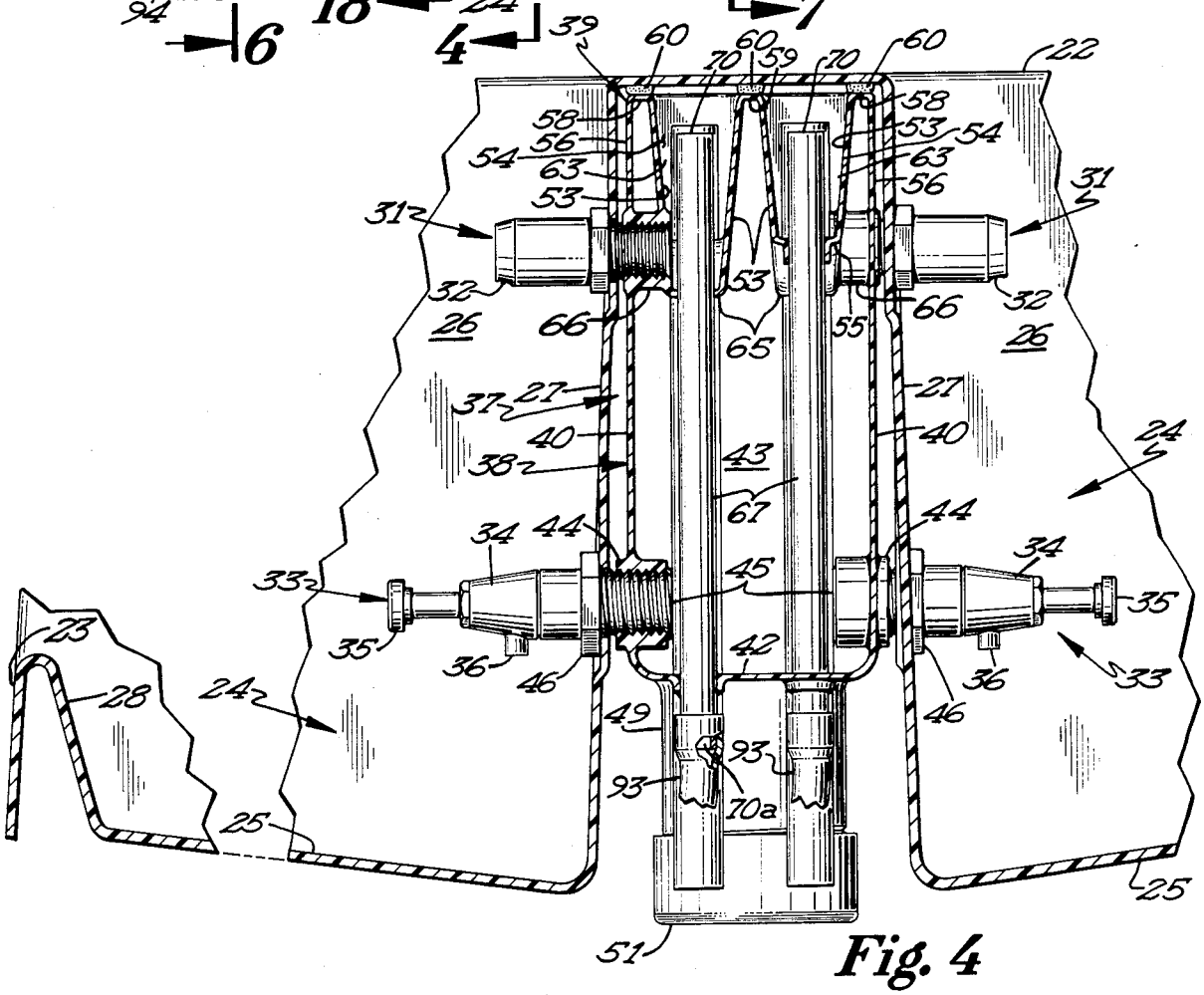
FIG. 4 is a cross-sectional view taken approximately along the line 4—4 of FIG. 3 and looking in the direction of the arrows.

The reservoir structure is also formed of plastic in a molding operation and the soap reservoir 38 includes a pair of outer walls 40, a bottom wall 42, and side walls 43, as best seen in FIGS. 2 and 4. The outer walls of the soap reservoir each have an internally threaded coupling element 44 molded thereto adjacent the bottom wall 42 thereof. The coupling element 44 is a molded in feature. At any rate, each coupling element 44 is internally threaded and is threadedly engaged by the externally threaded rear portion 45 of the soap pump extension 46. The pump extension 46 is comprised of a hollow cylinder through which soap travels to the soap pump. This extension has male threads where it engages the coupling element 44 and female threads where it engages the threaded rear portion of the pump body 34 for the soap dispenser pump. It will be noted that the soap dispenser pumps 33 are each connected in communicating relation with the soap reservoir, at substantailly the same vertical level. However, the soap dispenser pump for one wash basin is laterally offset with respect to the soap dispenser pump for the other wash basin.

The soap reservoir 38 has an inlet opening 47 in the bottom wall thereof and this inlet opening 47 is defined by an elongate downwardly projecting tubular inlet extension 49 which is molded as part of bottom wall 42. The lower end of the tubular extension 49 is externally threaded and is threadedly engaged by a closure cap 51, which is provided with a gasket 52 for closing the neck and inlet opening in sealing relation. It is pointed out that, when the dispenser housing 12 is swung from the closed to the open position, the inlet opening and the tubular extension 49 will be disposed or positioned upwardly. The cap may be removed and the soap reservoir may be filled, and the cap may then be applied to the tubular extension to close the same.

The metering water receptacles each provide water for one of the wash basins, as best seen in FIGS. 2, 4, and 5. Each metering receptacle includes upwardly diverging walls 53, end walls 54, and a bottom wall 55. Referring now to FIG. 4, it will be seen that the upper portion of the outer walls 40 of the soap reservoir 38 are molded as a part of the lower portions 57 of corresponding outer walls 56 for the water metering receptacles. It will be seen that each outer wall 56 is interconnected by a flat portion 58 to the diverging sloping walls 53. The two adjacent diverging walls 53 for the two water metering receptacles are also joined together by a flat transverse portion 59, as best seen in FIG. 4. Suitable seals 60 are interposed between the flat portions 58, 59, and the lower surface of the top wall of the dispenser housing to form a seal thereat. Thus, each water metering receptacle defines an upwardly facing metering chamber 63, each of which is adapted to contain a predetermined amount of water.

It will also be noted that the inner and outer front walls and the outer wall and an upwardly divergent wall of each metering receptacle are provided with openings for accommodating the molded-in couplings 66 for the water dispenser spout. Each coupling 66 is internally threaded and is threadedly engaged by the externally threaded rear end portion of the associated water dispenser spout to continuously intercommunicate the water dispenser spout with the associated metering chamber. It is pointed out that the lumen or opening through the water dispenser spout is cylindrical and is of uniform cross-sectional shape. It will also be noted that the lower wall 55 of each receptacle slopes inwardly to a central sump 65 which accommodates the inner end of the dispenser spout 31. With this arrangement, it will be seen that, when each metering chamber is filled with water, the water will flow outwardly thereof by action of gravity through the associated water dispenser spout.

The bottom wall 42 of the soap dispenser has a double pair of openings therein, each accommodating one of a pair of vertically disposed elongate inlet pipes 67 and one of a pair of vertically disposed elongate overflow tubes 69. Each inlet pipe 67 also extends through an opening in the bottom wall 55 of one of the water metering receptacles for discharging water into the chamber thereof. It will also be noted that each overflow tube 69 for each metering receptacle has its upper end communicating with one of the associated metering chambers 63. It is also pointed out that the lower end of each overflow tube 69 communicates with the source of fresh water. With this arrangement, water is pumped through the inlet pipes 67 into the associated metering chambers. The upper level of water within the metering chamber is limited by the overflow tubes 69 and the overflow water will be returned to the source of fresh water.

Water, which is pumped into the metering chambers 63, is supplied from a bag 71 containing water and positioned in the container 11, as best seen in FIG. 2. The bag 71 is of open-top impervious construction and fills a major portion of the interior of the container. However, the bag is constructed so that a small volumetric space 75 of the interior of the container 11 is left unoccupied when the bag 71 is filled with water.

Means are provided for supporting and retaining the upper edge portions of the bag 71 in an open condition. This means includes a generally rectangular shaped bracket 72, which is supported and secured to a horizontal ledge 73, the latter being integral with the interior surface of the container 11 and projecting inwardly thereof adjacent the upper edge 74 of the container. It will be seen that the bracket 72 is of L-shaped configuration and includes a horizontal leg 76 and a vertical leg 77. The horizontal leg 76 is positioned upon that portion of ledge 73 which projects from one of the side walls 16 of the container 11 and from a portion of the front and rear walls thereof. The upwardly projecting portion of the ledge defines a lip **73*a*. It will be noted that one side of the rectangular shaped bracket 72 does not engage the ledge and extends in a fore and aft direction across the interior of the container. The upper edge portion of the bag 71 is folded over the vertical leg 77 of the bracket 72 and is retained in place by an elastic rubber retainer 78. In a latter described embodiment (see FIGS. 21, 23**), a molded tray retains the bag in place.

It will be seen that the drain openings 29 for each wash basin 24 are positioned over the volumetric space 75. Therefore, the soiled or dirty water will pass through the drain opening and will fill the volumetric space 75 as clean water is being pumped from the bag 71.

Means are provided for supplying water from the water reservoir bag 71 in the container 11 into the metering chambers 63. This means includes a pair of manually operable water pumps 79, each being operable to pump water from the reservoir bag into one of the metering chambers. Each water pump 79 includes a pump body or cylinder 80 provided with a piston or plunger 81, which is reciprocal therein, the actuating piston having a disc-shaped hand-engaging member 82 to facilitate movement of the piston by a user. It will be seen that each water pump 79 is positioned in a recess or pump compartment 83 in the front or rear portion of the dispenser housing, and each pump is mounted by a mounting ring bracket 84 to the recessed front wall 85 of the recessed rear wall 86, defined by the recess. It will be noted that the recess or pump compartment 83 and the associated pumps 79 are located at opposite corner portions of the dispenser housing 12. One of the side walls 26 of the associated wash basin 24 and end wall 21 of the dispenser housing cooperates with each other to define the recess or pump compartment 83.

The interior of the pump body 80 defines a pump chamber in which the piston 81 reciprocates. The pump body 80 is provided with an inlet 87 through which water is introduced into the pump chamber and an outlet 88 through which water is discharged. Although not shown in the drawings, the inlet and outlet for each pump are each provided with a spring urged check valve of well-known construction, which is operable to control the flow of water through the pump. Further, a spring (not shown) is positioned in the pump chamber for urging the piston outwardly and for yieldably resisting inward movement of the piston. In this regard, it is preferred that the pump 79 be of the type manufactured by Whale Tip-Toe Intra Corp., of Medford, Mass., and sold as model number MKIV.

It will be seen that the inlet 87 of each pump 79 is connected by one of a pair of conduits 89 to one of a pair of branches 91 of a Y-connector 90. The other branch of the Y-connector is connected to one end of an elongate supply conduit 92, which extends downwardly into the bag 71. It is preferred that the conduit 92 be of flexible construction and that the free end thereof be provided with a weight to assure that the inlet end of the supply conduit is positioned adjacent the lower end portion of the bag 71. With this arrangement, it, will be seen that, when either of the pumps 79 are manually operated by a user, water will be evacuated from the interior of the bag 71 and will be urged by suction into the associated pump body 80.

The outlet 88 of each pump is connected to one end of an elongate conduit 93, the other end of each conduit 93 being connected to the inlet end **70*a* with one of the inlet pipes 67. Therefore, after initial priming, upon each subsequent stroke of the piston for each pump, water will be directed through the pump from the bag and will be introduced into one of the metering chambers 63. The cross-sectional size of each conduit 93 is substantially larger than the cross-sectional size of the water dispenser outlet or spout 31. In the embodiment shown, the cross-sectional size of the conduit 93 is approximately twice the cross-sectional size of the water dispenser outlet 31. With this arrangement, each water metering receptacle can be filled, even though water is continuously discharged therefrom through the outlet 31**. A user can operate one of the water pumps to fill the associated metering receptacle and then stop operation of the water pump, and water will continue to be discharged from the water outlet.

Figure 6:
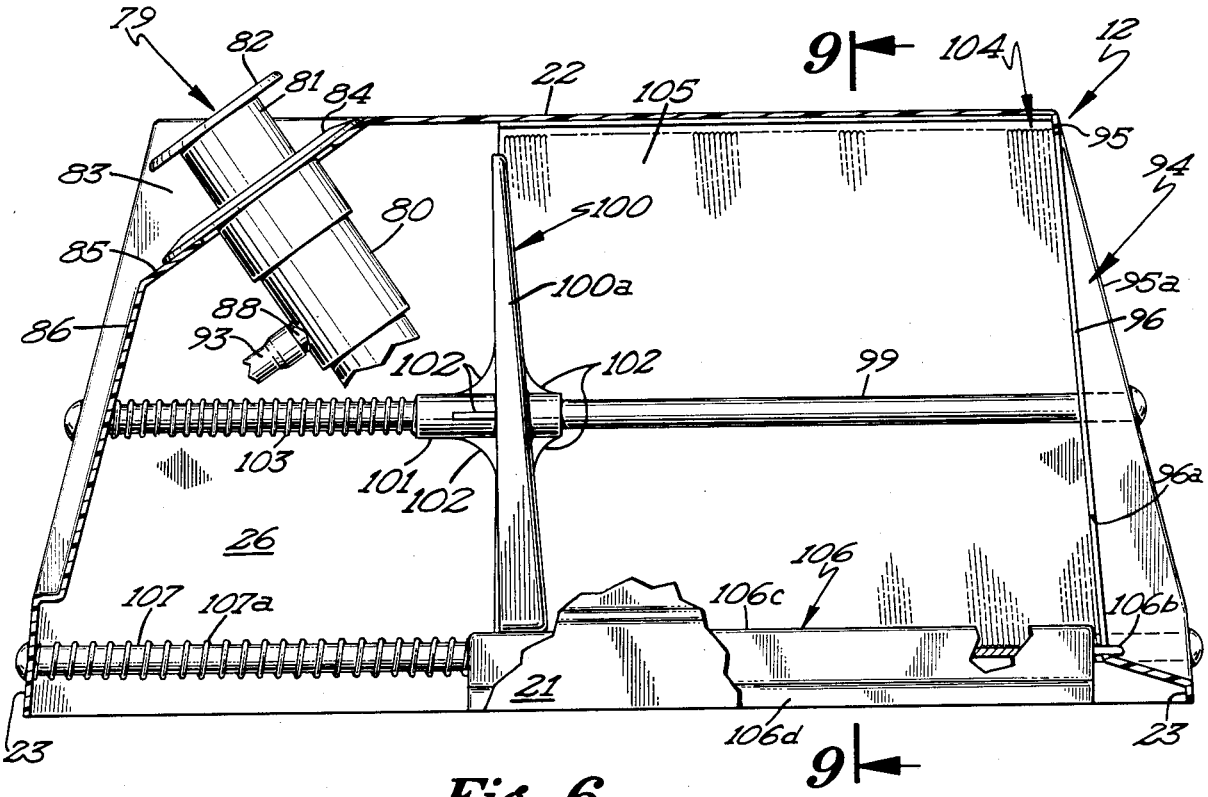
FIG. 6 is a cross-sectional view taken approximately along the line 6—6 of FIG. 3 and looking in the direction of the arrows.
Figure 9:
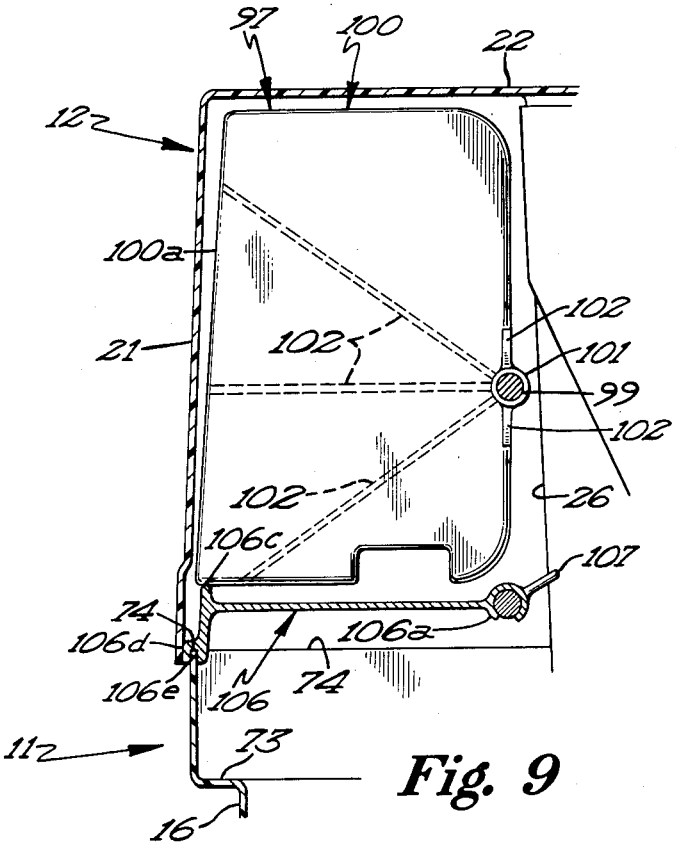
FIG. 9 is a cross-sectional view taken approximately along the line 9—9 of FIG. 6 and looking in the direction of the arrows.
Figure 11:
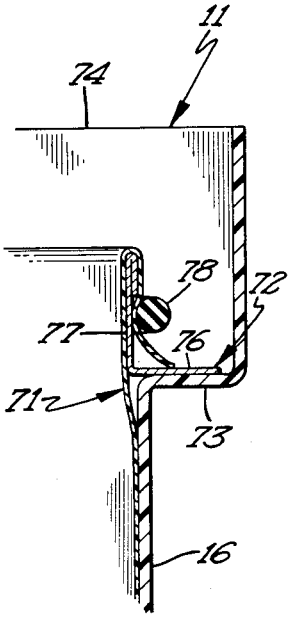
FIG. 11 is a cross-sectional view taken approximately along the line 11—11 of FIG. 2 and looking in the direction of the arrows.

The dispenser housing 12 is also provided with a pair of towel dispenser compartments 94, each being located in the front or rear portion of the dispenser housing, as best seen in FIGS. 1, 6, and 9. It will be noted that the towel dispenser compartments are located in opposite corner portions of the dispenser housing, and each is located on one side of the associated wash basin, while the pump compartment recess 83 is located on the other side of the wash basin. Each towel dispenser compartment includes a recessed front or rear wall 86, each wall having a vertical slot 96 therein through which the towels are dispensed.

Figures 20, 21:
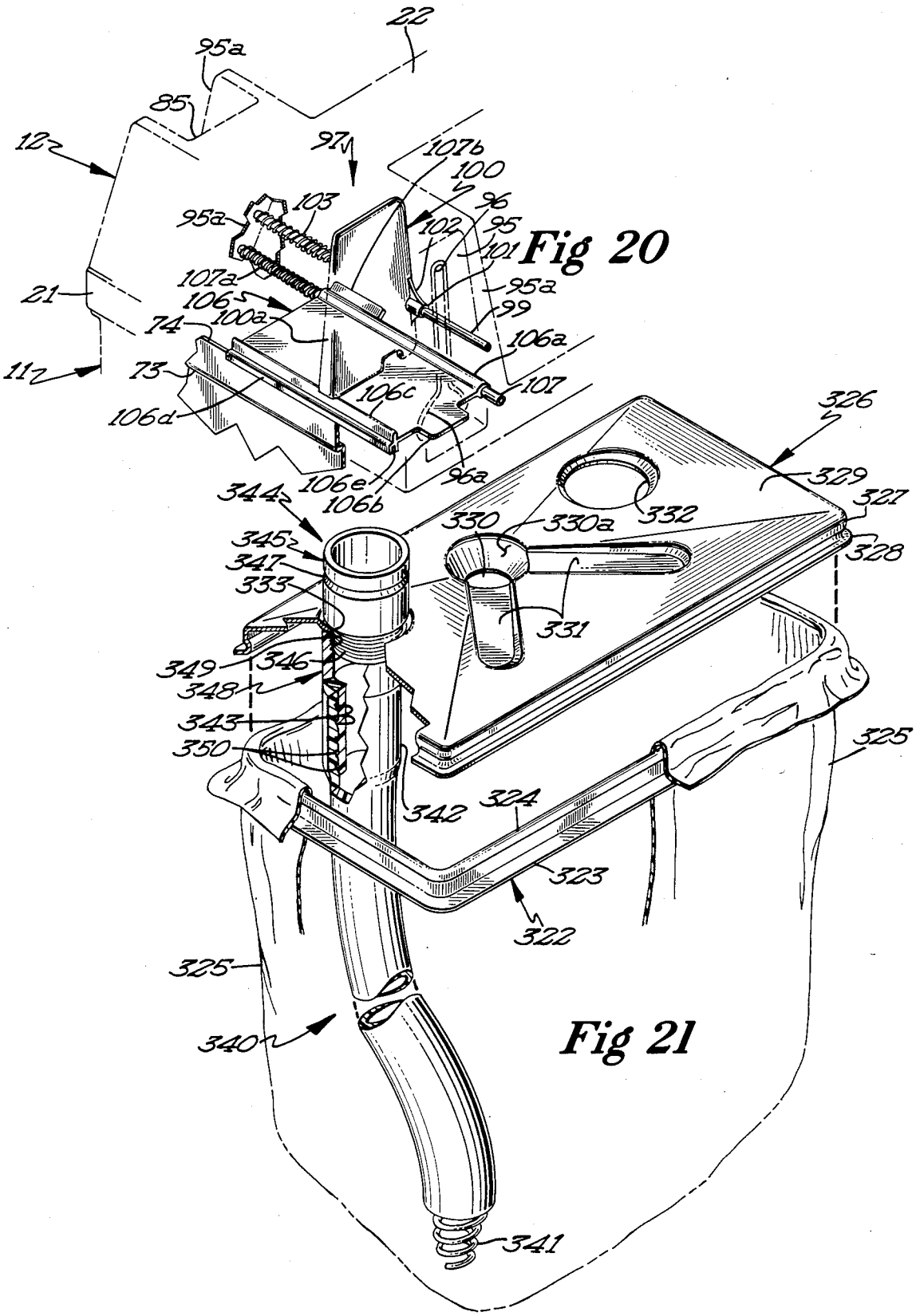
FIG. 20 is a perspective view of a portion of the towel dispensing mechanism.
FIG. 21 is a partially exploded perspective view of certain components of a modified form of the hand wash unit.

Referring now to FIGS. 6, 9, and 20, it will be seen that each towel dispenser, designated generally by the reference numeral 97, includes an elongate substantially straight rod 99, which projects through openings in the recessed walls 95 and is secured thereto by suitable rivets 98. It will be noted that the towel dispenser housing extends in a fore and aft direction adjacent the wash basin compartment 24. The rod is secured by rivets 98 through the ribs **95*a*** of the dispenser housing between the towel dispensers and basin, and extends in a fore and aft direction.

A Substantially flat, generally rectangular pressure plate 100, having peripheral flanges **100*a*, is molded with a sleeve or collar 101 along one edge thereof, and the collar is positioned over the rod 99** for movement therealong. Suitable triangular shaped reinforcing webs 102 are molded to the collar and to the pressure plate 100. A coil spring 103 is positioned around the rod 99 and has one end thereof engaging the inner wall of the rib 95*a* of the dispenser housing and the other end thereof engaging the sleeve or collar 101. Thus, it will be seen that the collar and pressure plate are urged in a direction towards the slot 96 in the associated front or rear wall 95.

The side wall 21, the side wall 26 of the wash basin housing, and the recessed front or rear wall 95 all cooperate to define an interior towel dispensing chamber 105. This interior towel dispensing chamber is adapted to contain a plurality of towels 104, which are positioned between the pressure plate 100 and the wall 95 so that the towels are constantly urged towards the slot 96. The fold of each succeeding towel will project through the slot 96 for easy access and removal by a user. The slot 96 has a widened opening 96*a* at the bottom to allow the user to start the first towel of a bunch. This widened opening is also configured so that it provides a bottom lip 96*b* onto which he towel access door 106 is positioned.

Access to the interior towel dispensing chamber 105 is provided by an access door 106, which pivots and slides on a rod 107 running horizontally from each outer vertical wall 23. The access door is formed of plastic material of which one side is tubular and includes a sleeve 106*a* integral with one edge portion thereof and accommodating the horizontal rod 107 therein. In its normal position, the access door 106 is supported by the upper lip or edge 74 of the receptacle 11, as shown in FIG. 9, and the bottom lip 96*b* of the towel dispensing slot 96, as shown in FIG. 6. The access door 106 is held in this position by a compression spring 107*a*. This compression spring 107*a* is positioned around the horizontal rod 107 and exerts a force upon the access door 106 that keeps the front tongue 106*b* of the access door engaged in the towel dispensing slot 96.

Figure 18:
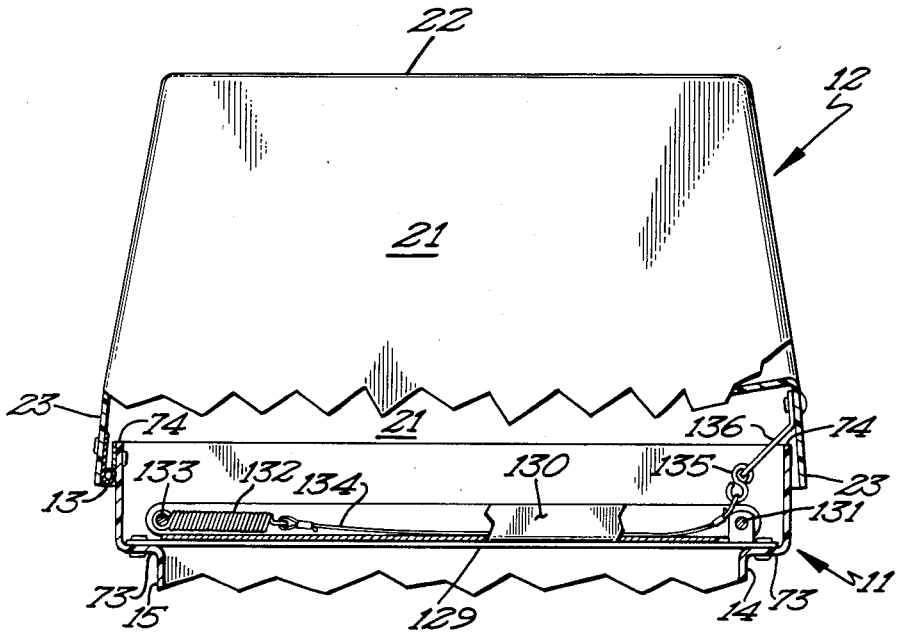
FIG. 18 is a fragmentary end elevational view of the dispenser housing of the hand wash unit in the closed position, with certain parts thereof broken away for clarity.
Figure 19:
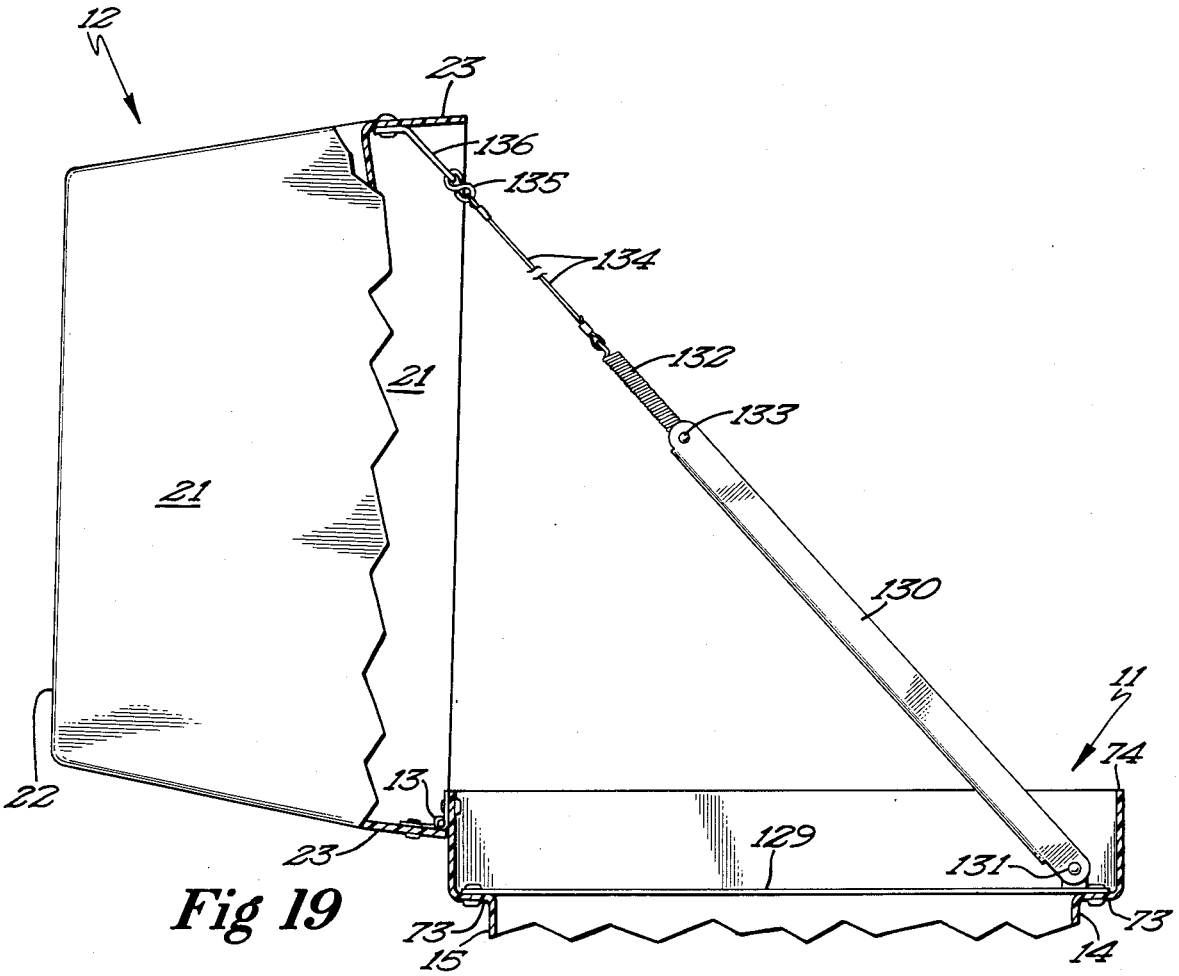
FIG. 19 is an end view of the dispenser housing of the hand wash unit in the open condition, with parts thereof broken away for clarity.
Figure 22:
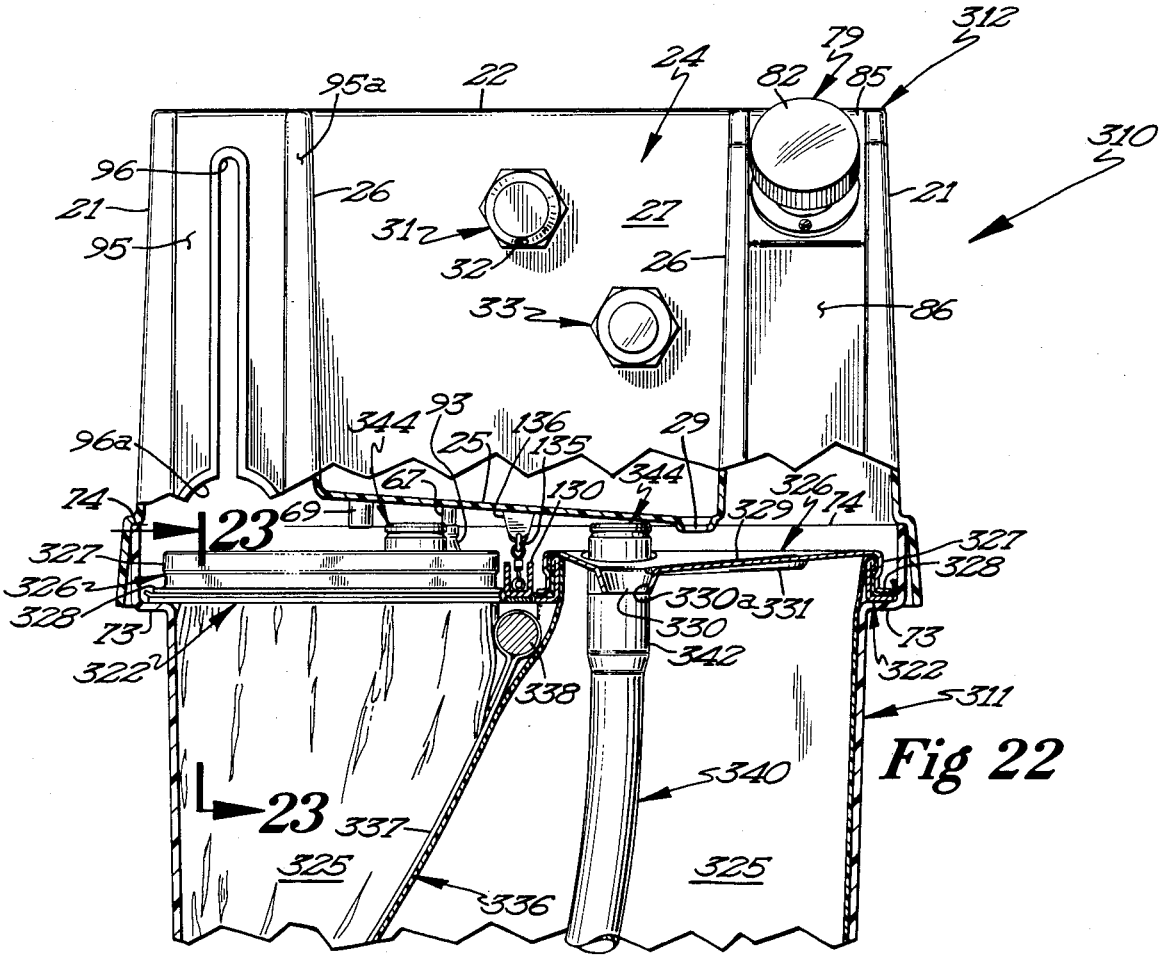
FIG. 22 is a fragmentary elevational view of an assembled hand wash unit embodying the modifications of FIG. 21 and with certain parts thereof broken away for clarity.

Referring now to FIGS. 18 and 19, it will be seen that means are provided for limiting pivoting movement of the dispenser housing 12 in its movement to the open condition. FIG. 18 illustrates the dispenser housing in the closed condition and FIG. 19 illustrates the dispenser housing in the open condition. The means for restraining movement of the dispenser housing in the open condition comprises an elongate link 130 having one end thereof pivotally connected by a pivot 131 to an ear secured to one end of an elongate strap 129. The link 130 is of U-shaped cross-sectional configuration, as illustrated in the embodiment of FIG. 22. The strap 129 extends in a fore and aft direction across the central portion of the container 11 and has opposite ends thereof secured to opposed portions of the horizontal edge 73 of the container. The other end of the link 130 is pivotally connected to a pivot 133 to one end of a helical spring 132. The other end of the helical spring 132 is provided with a loop which is connected to the looped end of an elongate flexible cable 134.

The other end of the flexible cable is provided with a loop which is connected to an S-shaped swivel connector 135. The connector 135 extends through an opening in a bracket 136, which is secured to the front wall 23 of the dispenser housing 12.

With this arrangement, it will be seen that, when the dispenser housing is pivoted to the open position for servicing, the link 130, spring 132, and cable 134 serve to restrain further movement of the housing 12 with respect to the position illustrated in FIG. 19. When the dispenser housing 12 is in the closed position, the link 130 is positioned upon the strap 129 and the cable 134 and spring 132 are positioned within the confines of the U-shaped elongate link.

The access door 106 is provided with a flange 106*c* along one side thereof, which extends throughout the length of the door. The flange 106*c* has an outwardly projecting extension integral therewith and terminating in a downturned lip 106*d* which cooperates with the flange to define a locking recess 106*e*. It will be seen that the locking recess 106*e* engages the associated upper edge of the container 11 when the door 106 is in the closed position. The spring 107*a* urges the door to the closed position.

When the access door 106 is shifted to the open position for resupplying paper towels to the compartment, the plate 100 will be retracted against the bias of the spring 97 to a position so that the edge of the tab 107*b* on sleeve 107 engages the plate 100 to hold the same in the retracted position.

Means are provided for releasably locking the dispenser housing to the tank 11, and this means includes a cam lock 109, which is pivotally connected to the tank 11 by a pivot 110. It will be noted in FIGS. 7 and 8 that the cam lock 109 is located along the rear wall and oppositely of the hinge 13. In this regard, the position of the hinge 13 and the cam lock 109 may be reversed.

The cam lock 109 has a locking hook 111 defined by a recess 112 in the cam lock. The locking hook 11 is adapted to engage a lock engaging element 23*a* on the dispenser housing 12. Movement of the cam lock 109 is accomplished by inserting a screw driver wedge into the actuating slot 113 in the cam lock. The cam lock may then be readily rotated between the locked and unlocked positions by rotation of the screw driver.

The hand wash unit, which functions as a free-standing unit, is primarily intended for outside use. The bag 71 will be filled with fresh clean water and the soap dispenser chamber 38 will be filled with a suitable commercial liquid soap. The unit will also be provided with a supply of disposable paper towels for each of the interior towel dispensing chambers.

A user will manually reciprocate one of the water pumps 79, thereby pumping water from the bag 71 through the pump and into the associated metering chamber 63. The pumping will fill the metering chamber and water will be dispensed through the water dispenser spout 31 because of its location relative to the metering chamber. A user may then stop actuation of the pump and dispense liquid soap from the soap dispenser pump upon the user's hands and then use the water being dispensed from the water dispenser spout 31 from the metering chamber to complete the hand washing action. It will be seen that, by using a temporary reservoir of water in the metering chamber, a user is not required to constantly actuate the pump to obtain water for washing his hands. If the user overfills the water dispenser, the excess water will flow outwardly through the overflow recess 69 and will be returned through the open top of the bag 71. In this regard, the overflow recesses for each of the metering water receptacles 39 are located so that the water will drain downwardly into the bag.

The used or dirty water will be discharged through the drain opening 29 of the wash basin 24 and will drain downwardly into the volumetric space 75 in the tank 11, but exteriorly of the bag 71. Thus, it will be seen that, as water is evacuated from the interior of the bag 71, the same water will progressively fill the volumetric space 75. With this arrangement, the single tank serves as a receptacle for both the fresh and dirty water, while the bag 71 prevents mixing of the dirty water with the fresh water. It is pointed out that both wash basins may be used simultaneously, since each water pump 79 may pump water from the bag 71 independently of the other water pump. Similarly, each soap dispenser pump 33 may dispense soap from the soap reservoir 38 independently of the other soap dispenser pump. Each water pump 79 is positioned adjacent the associated water basin, as is the associated towel dispenser compartment 94. Thus, the user has ready access to a water supply, soap supply, and disposable towels while standing at the wash basin.

In servicing the hand wash unit, an operator may readily replace the fresh water supply, the liquid soap supply, or the supply of towels through the simple expedient of unlocking the cam lock 109 and pivoting the dispenser housing 12 to the open position. If the bag 71 is to be removed, it is merely necessary to remove the molded tray from engaging relation with the vertical leg 77 of the bracket 72. The bag may be removed and the dirty water may be emptied as desired. It is pointed out that the bag 71 may be emptied without removing the bag from the container. A fresh water bag may then be inserted into the tank 11 after removal of the dirty water and the upper end portion of the bag may be again retained in place by applying the water tray to the bracket 72. Liquid soap may be added into the soap reservoir 38 by removing the cap 51 and pouring the liquid soap into the reservoir. The cap 51 will then be replaced to close the tubular extension 49 in sealing relation.

When the supply of towels 104 is exhausted, the operator, after shifting the dispenser housing 12 to the open position, will open the access door 106. The access door 106 can be opened by sliding it along the horizontal rod 107 so that the tongue 106*b* on the access door disengages from the towel dispensing slot 96. Then, the access door 106 can be rotated on the horizontal rod 107 so that the towel dispensing chamber is exposed. Furthermore, the pressure plate 100 can then be slid from the towels 105 until it rests against the water pump 79. At this time, the access door can be rotated further on the horizontal rod so that the tab 107*b* retains the pressure plate in the loading position. The towels will be inserted into the interior towel dispensing chamber 105. The access door 106 will be closed, allowing the pressure plate 100 to move forward against the towels. Then, the tongue 106*b* of the access door can be engaged into the bottom of the towel dispensing slot 96, thereby retaining the access door in position. The dispenser housing 12 will be swung to the closed position and the cam lock 109 will be swung to the closed position and the cam lock 109 will be actuated to shift the same to a locked position to releasably lock the dispenser housing in its closed position.

It is pointed out that the lower end portion of the tank 11 may be provided with openings in the bottom wall of one or more of the vertical walls thereof to permit drainage of the dirty water from the container 11. It is also pointed out that the container 11 may also be provided with an impervious bag similar to the bag 71 for receiving the dirty water therein, and which will be substantially collapsed when the tank contains a full bag of fresh water. With this arrangement, the dirty water bag will be progressively filled as the clean water bag is progressively emptied.

Referring now to FIGS. 12–17, it will be seen that a different embodiment of the container and reservoir bags therefor is thereshown. The container, designated generally by the reference numeral 211, is also a generally rectangular shaped configuration and includes a front wall 214, a rear wall 215, opposed side walls 216, and a bottom wall 217. The vertical walls of the container are provided with recesses 218, which define embossed portions 219 therebetween in the manner of the embodiment of FIGS. 1–11. It will be seen that the container 211 is provided with an interior annular ledge 220, which is adjacent, but spaced downwardly from, the upper edge 221 thereof.

Figure 13:
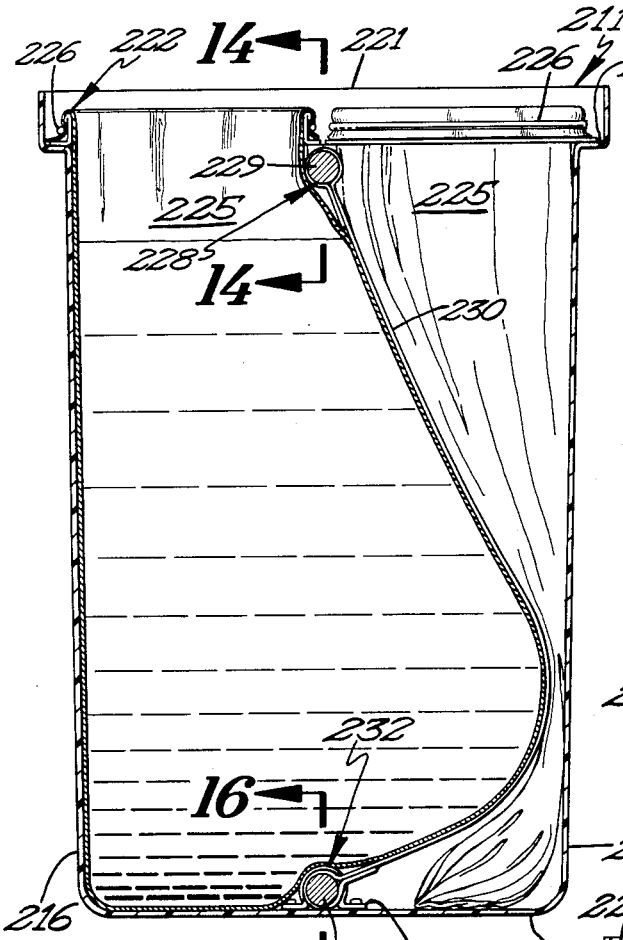
FIG. 13 is a cross-sectional view taken approximately along the line 13—13 of FIG. 12 and looking in the direction of the arrows, illustrating the bag containing the fresh water in a substantially filled condition, and illustrating the bag used to contain the soiled water in a substantially empty condition.
Figure 15:
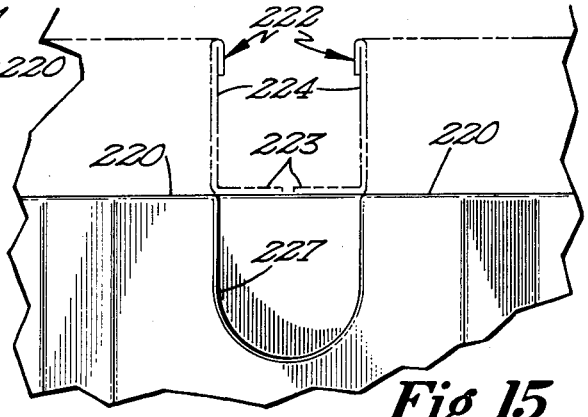
FIG. 15 is a cross-sectional view taken approximately along the line 15—15 of FIG. 14 and looking in the direction of the arrows.
Figure 17:
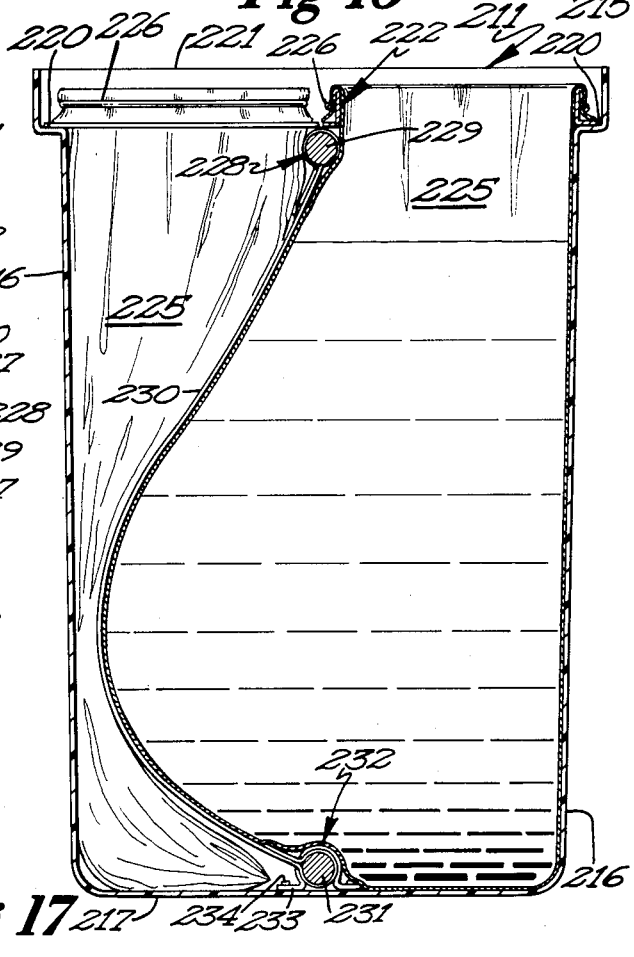
FIG. 17 is a cross-sectional view similar to FIG. 13, but illustrating the bag containing fresh water in a substantially empty condition and the bag containing the soiled water in a substantially filled condition.

The container 211 is provided with a pair of substantially identical rectangular shaped brackets 222, each being dimensioned within approximately one-half of the cross-sectional area of the interior of the tank. The brackets 222 are positioned upon the edge 221, and each is of L-shaped cross-sectional configuration. In this respect, the horizontal leg 223 is positioned upon the ledge 220 and the vertical leg 224 projects upwardly therefrom. Referring now to FIGS. 13 and 17, it will be seen that the adjacent sides of the brackets 222 are spaced closely adjacent to, but spaced slightly apart from, each other, adjacent the transverse center line of the container 211.

Figure 12:
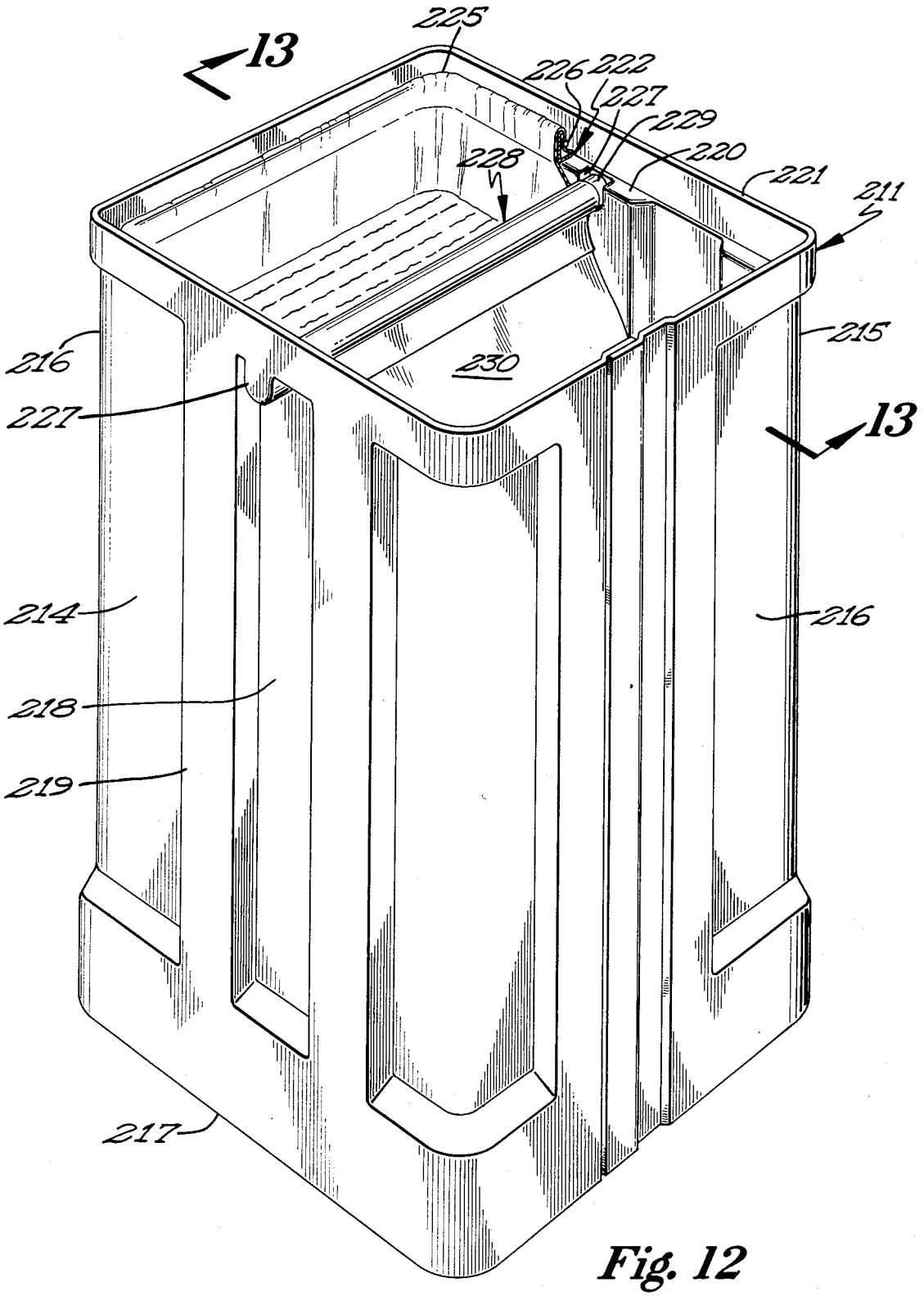
FIG. 12 is a perspective view of a modified form of the container for the hand wash unit.

The container 211 accommodates a pair of substantially identical open top bags 225 formed of an impervious plastic material, and each bag has its upper end portion folded over one of the brackets 222 and is secured thereto by a water tray in the manner of the previously described embodiment. It will also be noted that the interior of the container 211 has a pair of diametrically opposed socket recesses 227 formed therein, each socket recess opening upwardly through the ledge 220, as best seen in FIG. 12. It will also be noted that the sockets are arranged along the general transverse center line plane of the container 211.

Figure 16:
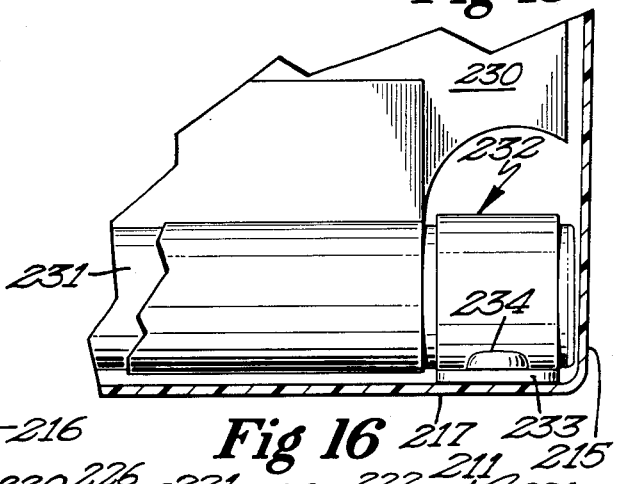
FIG. 16 is a cross-sectional view taken approximately along the line 16—16 of FIG. 13 and looking in the direction of the arrows.
Figure 14:
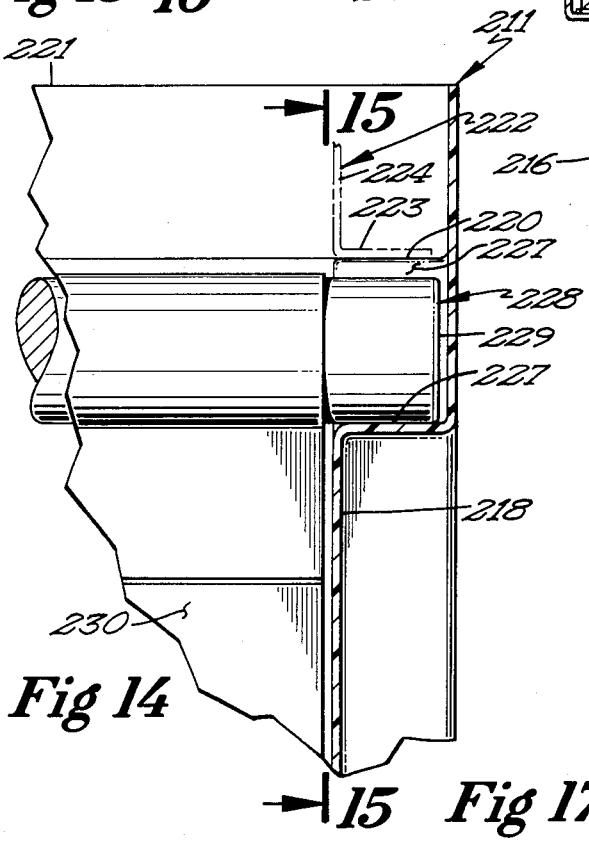
FIG. 14 is a cross-sectional view taken approximately along the line 14—14 of FIG. 13 and looking in the direction of the arrows.

The container 211 is also provided with a separator 228, which separates the interior of the container into two separate compartments, as best seen in FIGS. 12, 13, and 17. The separator assembly includes an elongate substantially straight rigid upper rod 229 having opposite ends thereof positioned within the socket recesses 227. An elongate generally rectangular shaped tubular flexible panel 230, formed of an impervious plastic material, has its upper end portion wrapped about the upper rod 229 to form a loop. The lower end portion of the flexible panel 230 is wrapped about a rod 231 to form a loop, as best seen in FIG. 16. The lower rod 231 is identical in size and shape to the rod 229, and is secured to the bottom wall 217 of the container by a pair of U-shaped brackets 232. In this regard, the U-shaped brackets each engage one end of the lower rod 231, and each bracket 232 has outturned legs 233, which are secured to the lower wall by suitable rivets 234.

It will be noted that the vertical dimension of the flexible panel 230 is somewhat greater than the corresponding vertical dimension of the container 211, as best seen in FIGS. 13 and 17. With this arrangement, when one of the bags 225 is in the filled condition, the other bag will be in a substantially empty condition. Referring now to FIG. 13, it will be seen that the bag 225 containing the clean water is in a substantially filled condition, while the other bag is in an empty condition. In this regard, the empty bag illustrated in FIG. 13 is adapted to receive dirty water from the wash basins when a user uses the hand wash unit. Therefore, as water from the bag containing clean water is progressively used, this bag will become progressively emptied. Conversely, the bag into which the soiled water will pass will become progressively filled. Therefore, when the clean water is completely exhausted, the bag containing the dirty water will be substantially filled. In this manner, the flexible panel takes all of the stress from the load of water off of the bags. The bag containing the dirty water may be emptied during the servicing operation.

Figure 23:
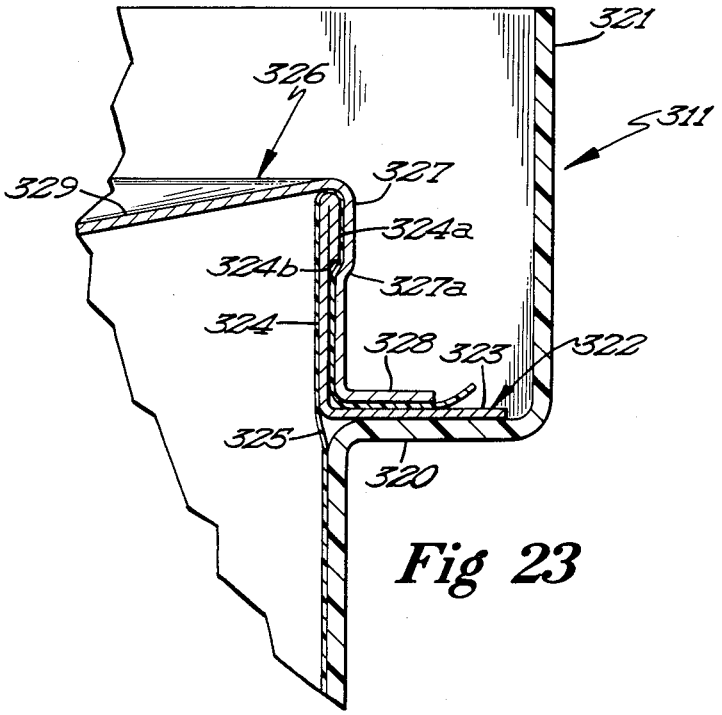
FIG. 23 is a cross-sectional view taken approximately along the line 23—23 of FIG. 22 and looking in the direction of the arrows.

Referring now to FIGS. 21, 22, and 23, it will be seen that a modified form of the novel hand wash unit, designated generally by the reference numeral 310, is thereshown. The hand wash unit 310 includes a cohntainer 311 having a dispenser housing 312 pivoted thereto in the identical manner to the previously described embodiments. In this regard, the construction of the container and dispenser housing are identical in detail to the previously described embodiments. The container 311 preferably contains two bags, as shown, although a bag unit may also be provided. In the previously described embodiments, the upper portion of each bag was clamped against a rectangular-shaped support frame by an elastic ring.

In the embodiments of FIGS. 21–23, a similar rectangular-shaped frame 321 is provided, which includes longitudinal side portions and end portions. The support frame 321 is supported upon the ledge 320 of the container 311 and is spaced inwardly from the vertical edge portion 321. The rectangular-shaped frame 322 is of L-shaped cross-sectional configuration and includes a horizontal leg 323, which is supported on the horizontal ledge 320 of the container. The rectangular frame also includes a vertical leg 324 which is folded at its upper end upon itself as at 324 and defines a downwardly facing shoulder of bead 324*b*. The rectangular frame may be formed of any suitable rigid material, such as plastic, metal, or the like. Two such frames are provided for each container.

Referring now to FIG. 21, it will be seen that the upper portion of each flexible bag 325 is folded over the vertical leg 324 of the associated rectangular frame 322 and is clamped thereagainst by a generally rectangular-shaped tray 326. The tray 326 may be formed of any suitable rigid material, preferably plastic or the like, and includes vertically disposed longitudinal end walls 327. Each vertical wall 327 terminates downwardly in an outturned horizontal portion 328. The tray 326 also includes a central horizontal wall 329 which slopes inwardly from each vertical end and longitudinal wall towards a generally centrally located opening 330. The opening 330 is defined by a generally downwardly tapered wall 330*a*, as best seen in FIG. 21. The horizontal wall 329 also has a pair of elongate recessed portions 331 formed therein which converge towards each other and communicate with the opening 330. The recessed portions 331 define drain channels. The horizontal wall 339 also has an opening 332 therein and an opening 333 therein, each positioned on one side of the opening 330.

Referring now to FIG. 23, it will be seen that each vertical longitudinal and end wall 327 has an offset portion 327*a* intermediate its ends which is dimensioned to snap under the shoulder or bead 324*b* of the rectangular frame when the tray is applied to the frame. Thus, the tray is frictionally held in place when so applied to the bag supporting rectangular frames.

In the two-bag hand wash unit, the unit will be provided with a separator 136, which is formed of a flexible impervious rectangular-shaped plastic panel 337, which is folded upon itself and heat-sealed to form upper and lower loops in the manner of the previously described embodiment. The upper and lower loops of the separator 136 accommodate upper and lower elongate rigid substantially straight rods 139. Although not shown in the drawings, the ends of the upper rod 338 will be positioned in socket recesses formed in the container. It is again pointed out that the separator 136 serves to absorb some of the load exerted by the water and thereby lessen the chance of rupture or breakage of the bag wall.

Referring again to FIGS. 21 and 22, it will be seen that a rigid plastic service connection coupling device 344 is connected to the tray 326 to allow for the emptying of the water supply. The coupling device includes a male quick-connect coupling 345 which rests on the top of the water tray 326 and has a lower end with male threads 346 that extend downward through the opening 333 in the tray so that a mating female-threaded coupling 348 can be attached to it, thereby attaching the two parts solidly to the water tray. This lower female coupling 348 has one upper end with female threads 349 and one lower end with male barbs 350. A large diameter hose 340 having female barbs 343 is pushed over the male barbs 350 and secured with a hose clamp. This hose 340 extends downward almost to the bottom of the water reservoir bag. A large extension spring 341 is screwed part way into the inside diameter of the hose 346 to prevent the bag from being sucked up to the bottom opening of the hose when the water is being evacuated from the bag.

To empty the water from the bag without disturbing either the tray or bag, a vacuum hose with a female quick-connect coupling is attached to the male coupling by way of the coupling groove 347, and the vacuum system is engaged. In this manner, the water can be removed from the bag without contaminating the residual remaining water or the bag itself.

Each hose 340 has a helical spring 341 secured to the lower end and projecting downwardly therefrom to engage the lower surface and space the lower end of the hose above the surface. The upper end of the conduit 340 for each bag is enlarged as at 342 and is provided with a plurality of inwarly projecting barbs 343, as best seen in FIG. 21. Means are provided for coupling the upper end portion of the conduit 340 to the retaining tray 326.

This means includes a coupling device 344, which is formed of a suitable rigid plastic material. The coupling device 344 comprises an upper male coupling member 345, which is provided with external threads 346 at its lower end and an extension coupling groove 347 adjacent its upper end.

The coupling device is also comprised of a female coupling member 348, which is internally threaded as at 349 adjacent its upper end for threadedly engaging the male threads 346 on the upper male coupling member 345. The female coupling member 348 is also provided with external teeth or barbs 349 adjacent its lower end which interdigitates or functionally engages the barbs 343 on the upper enlarged portion of the conduit 340 to secure the conduit to the female coupling member.

It will be seen that, when the male and female coupling members of the coupling device 344 are threadedly engaged, through the opening 333, the periphery of the tray defining the opening will be clamped between the coupling. The conduit 340 for one bag 325 will be used to empty dirty water therefrom and the other conduit will be used to replenish the bag with fresh water. It is pointed out that the extension coupling groove 347 in the male coupling member of the coupling device permits ready attachment and disengagement with a quick release snap coupling connected to the filler hose or suction hose associated with the service truck.

It is pointed out that the unique construction of the novel hand wash unit makes it suitable for use on uneven surfaces. Further, because of the unique construction and operation of the water dispensing system, both hands of the user are free for washing, and the hand wash unit is also adapted for use by handicapped persons having only one functional hand.

Finally, the novel hand wash unit, by avoiding excess use of water, is effective in conserving water during each hand washing operation and permits service for a planned number of users.

From the foregoing description, it will be seen that I have provided a hand wash unit which is readily transportable and which is formed of lightweight construction to permit a plurality of such units to be transported from site to site. It will also be seen that the hand wash unit is readily serviceable by an operator, making these units particularly adaptable for use at outdoor events, such as concerts, athletic events, and the like.

Thus, it will be seen that I have provided a novel hand wash unit, which is not only of simple and inexpensive construction, but one which functions in a more efficient manner than any heretofore known comparable device.

What is claimed is:

1. A portable hand wash unit comprising a vertically diposed rigid container formed of a plastic material and including an upper portion, a flexible impervious bag within said container adapted to contain clean water, said bag, when filled with clean water, filling a substantial volumetric space within said container, the upper portion of said container being shaped to define an external wash basin, including a lower wall having a drain outlet therein for permitting water to flow through the drain outlet and into the container exteriorly of said bag, means within the upper portion of said container defining a soap chamber containing liquid soap therein, means defining a soap dispenser connected in communicating relation with said soap chamber and being operable to dispense soap from the soap chamber at a location above the lower wall of said wash basin, means within the upper portion of said container defining a water metering chamber adapted to contain a predetermined amount of water, manually operable pump means on said container having an inlet connected in communicating relation with the interior of said bag and having an outlet connected in communicating relation with said water metering chamber, whereby, when said water pump means is operated, water will be pumped from the impervious bag to said water metering chamber, and means defining a water outlet continuously communicating with said water metering chamber and continuously discharging any water within the water metering chamber by action of gravity at a location above the lower wall of the wash basin, said water outlet means having a cross-sectional area substantially less than the cross-sectional area of the inlet for the water metering chamber, whereby a predetermined amount of water will be contained in the water metering chamber after the operation of the water pump means is discontinued.

2. A portable hand wash unit comprising a vertically disposed rigid container formed of plastic material and including an upper portion, a flexible impervious bag within said container adapted to contain clean water, said bag, when filled with clean water, filling a substantial volumetric space within said container, the upper portion of said container being shaped to define a pair of external wash basins, each including a lower wall having a drain outlet therein for permitting water to flow through the drain outlet of each wash basin into the container exteriorly of said bag, means within the upper portion of said container defining a soap chamber containing liquid soap therein, means defining a pair of soap dispensers, each being connected in communicating relation with said soap chamber and each being operable to dispense soap from the soap chamber at a location above the lower wall of one of said wash basins, means within the upper portion of said container defining a pair of water metering chambers, each being adapted to contain a predetermined amount of water, each water metering chamber having an inlet, a pair of manually operable pump means, each being mounted on the upper portion of said container and each having an inlet connected in communicating relation with the interior of said bag, each pump means having an outlet connected in communicating relation with the inlet of one of said water metering chambers, whereby, when one of said pump means is operated, water will be pumped from the impervious bag into one of said metering chambers, and means defining a pair of water outlets, each continuously communicating with one of said water metering chambers and continuously discharging any water within the associated water metering chamber by action of gravity at a location above the lower wall of one of said wash basins, each water outlet means having a cross-sectional area substantially less than the cross-sectional area of the inlet for the associated water metereing chamber, whereby a predetermined amount of water will be contained in one of the water metering chambers after the operation of the associated water pump means is discontinued.

3. The hand wash unit as defined in claim 1 wherein said metering receptacle is provided with an overflow outlet through which water is discharged, said overflow outlet being positioned so that water flowing therefrom will flow by action of gravity into the impervious bag when the predetermined volume has been exceeded.

4. The hand wash unit as defined in claim 1 wherein said impervious bag, when filled with water, fills a major portion of the volumetric space comprising the interior of said container, the unfilled volumetric space in said container defining a reception zone for receiving dirty water from the outlet in said wash basin.

5. The hand wash unit as defined in claim 1 wherein said water pump means includes a cylinder body, a piston movable in said cylinder body and projecting exteriorly of the container, said piston, when reciprocated, pumping water from the impervious bag into the water metering receptacle.

6. The hand wash unit as defined in claim 1 wherein said inlet for said water metering receptacle is approximately twice the cross-sectional size of said water outlet.

7. A portable hand wash unit comprising:

a vertically disposed open top tank formed of a molded plastic material, a flexible impervious bag within said tank adapted to contain water, said bag, when filled with clean water, filling a substantial volumetric space within said tank, a dispenser housing formed of a molded plastic material and being connected to the upper portion of said tank for movement relative thereto between open and closed positions, said housing, when in the closed position, forming a continuation of said tank and extending upwardly therefrom, and, when in the open position, being movable to expose the open top of the tank, said housing being shaped to define an external wash basin including a lower wall having a drain outlet therein for permitting water to flow through the drain outlet and into said tank exteriorly of said bag, a soap reservoir mounted in said housing and adapted to contain liquid soap, a soap dispenser pump mounted on said housing and having an inlet communicating with said soap reservoir for receiving soap therein, and having a discharge outlet positioned to discharge liquid soap into the wash basin, whereby, when said pump is operated, liquid soap will be discharged through the outlet, a water metering receptacle mounted within said housing and adapted to contain a predetermined volume of water, said water metering receptacle having an inlet through which water is supplied to the receptacle, a manually operable pump mounted on said housing and having an inlet connected in communicating relation with the interior of said bag, and having an outlet connected in communicating relation with said inlet of said water metering receptacle whereby, when said pump is operated, water will be pumped from the impervious bag to supply water to said water metering receptacle, and a water dispenser outlet connected in continuous communicating relation with the lower portion of said water metering receptacle and positioned to discharge water into the wash basin, whereby water within the water metering receptacle will flow continuously therefrom into the wash basin, said water outlet having a cross-sectional size substantially less than the cross-sectional size of the inlet of the water metering receptacle, whereby the water metering receptacle will contain a predetermined amount of water which is continuously discharged therefrom after the operation of the water pump is stopped.

8. The device as defined in claim 7 wherein the cross-sectional size of the inlet of said water metering receptacle is approximately twice the cross-sectional size of said water outlet.

9. The device as defined in claim 7 wherein said water metering receptacle has a downwardly inclined lower wall defining a sump at its lowermost portion, said water outlet communicating with said water metering receptacle at said sump.

10. The device as defined in claim 7 and a towel dispenser chamber within the dispenser housing adapted to contain a plurality of paper towels, an opening in said dispenser housing defining an outlet communicating with said towel dispenser chamber through which paper towels are dispensed, and yieldable means for urging the paper towels towards said opening to permit dispensing the towels one at a time from the towel dispensing chamber.

11. A portable hand wash unit comprising:

a vertically disposed open top tank formed of a molded plastic material, a flexible impervious bag within said tank adapted to contain water, said bag, when filled with clean water, filling a substantial volumetric space within said tank, an upper dispenser housing formed of a molded plastic material and being hingedly connected to the upper portion of said tank for movement relative thereto between open and closed positions, said housing, when in the closed position, forming a continuation of said tank and extending upwardly therefrom, and, when in the open position, being movable to expose the open top of the tank, said housing being shaped to define a pair of external wash basins, each including a lower wall having a drain outlet therein for permitting water to flow through the drain outlet and into said tank exteriorly of said bag, a soap reservoir mounted in said housing and adapted to contain liquid soap, a pair of soap dispenser pumps mounted on said housing and having an inlet communicating with said soap reservoir fro receiving soap therein, and each soap dispenser pump having a discharge outlet positioned to discharge liquid soap into one of said wash basins, whereby, when each soap dispenser pump is operated, liquid soap will be discharged through the outlet, a pair of water metering receptacles, each being mounted within said housing and adapted to contain a predetermined volume of water, each water metering receptacle having an inlet through which water is supplied to the receptacle, a pair of manually operable water pumps mounted on said housing and each having an inlet connected in communicating relation with the interior of said bag, and each water pump having an outlet connected in communicating relation with the inlet of one of said water metering receptacles whereby, when one of said water pumps is operated, water will be pumped from the impervious bag to supply water to said water metering receptacle, and a pair of water dispenser outlets, each being connected in continuous communicating relation with the lower portion of one of said water metering receptacles and positioned to discharge water into the associated wash basin, whereby water within a water metering receptacle will flow continuously therefrom into the associated wash basin, each of said water outlets having a cross-sectional size substantially less than the cross-sectional size of the inlet for the associated water metering receptacle, whereby each water metering receptacle will contain a predetermined amount of water which is continously discharged therefrom after the operation of the associated water pump is stopped.

* * * * *